US006224470B1

(12) United States Patent
Hoey et al.

(10) Patent No.: US 6,224,470 B1
(45) Date of Patent: May 1, 2001

(54) PAD CLEANING BRUSH FOR CHEMICAL MECHANICAL POLISHING APPARATUS AND METHOD OF MAKING THE SAME

(75) Inventors: Gee Hoey, San Jose; Manoohcer Birang, Los Gatos, both of CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/407,424

(22) Filed: Sep. 29, 1999

(51) Int. Cl.[7] ..... B24B 29/00

(52) U.S. Cl. ..... 451/285; 451/41; 451/60; 451/287; 451/443

(58) Field of Search ..... 451/41, 60, 287, 451/443

(56) References Cited

U.S. PATENT DOCUMENTS 5,486,131 * 1/1996 Cesna et al. ..... 451/56
5,868,863 * 2/1999 Hymes et al. ..... 134/28
5,885,147 * 3/1999 Kreager et al. ..... 451/443

* cited by examiner

*Primary Examiner*—Joseph J. Hail, III
*Assistant Examiner*—Shantese McDonald
(74) *Attorney, Agent, or Firm*—Thomason, Moser & Patterson

(57) ABSTRACT

A pad cleaning brush and method for making the same is used in conjunction with spray rinse water to thoroughly clean a polishing pad of a chemical-mechanical polishing apparatus after a wafer has been polished. The bristles of the brush are securely retained within the brush by a welding process. This prevents the bristles from remaining on the polishing pad after the cleaning operation, thereby preventing the remaining bristles from damaging a subsequently polished wafer.

7 Claims, 2 Drawing Sheets

PAD CLEANING BRUSH FOR CHEMICAL MECHANICAL POLISHING APPARATUS AND METHOD OF MAKING THE SAME

FIELD OF THE INVENTION

The present invention relates to chemical-mechanical polishing of substrates, and more particularly to a pad cleaning brush used to clean debris off a polishing pad after a wafer has been polished.

BACKGROUND OF THE INVENTION

Integrated circuits are typically formed on substrates, particularly silicon wafers, by the sequential deposition of conductive, semi-conductive or insulative layers. After each layer is deposited, the layer is etched to create circuitry features. As a series of layers are sequentially deposited and etched, the outer or uppermost surface of the substrate, i.e., the exposed surface of the substrate, becomes successively more non-planar. This occurs because the distance between the outer surface and the underlying substrate is greatest in regions of a substrate where the least etching has occurred, and least in regions where the greatest etching has occurred. For a single-patterned underlying layer, this non-planar surface comprises a series of peaks and valleys wherein the distance between the highest peak and the lowest valley may be on the order of 7,000 to 10,000 Angstroms. With multiple-patterned underlying layers, the height difference between the peaks and valleys becomes even more severe, and can reach several microns.

This non-planar outer surface presents a problem for the integrated circuit manufacturer. If the outer surface is non-planar, then photolithographic techniques to pattern photoresist layers might not be suitable, as a non-planar surface can prevent proper focusing of the photolithography apparatus. Therefore, there is a need to periodically planarize this substrate surface to provide a planar layer surface. Planarization, in effect, polishes away a non-planar outer surface, whether a conductive, semi-conductive, or insulative layer, to form a relatively flat, smooth surface. Following planarization, additional layers may be deposited on the outer layer to form interconnect lines between features, or the outer layer may be etched to form vias to lower features.

Chemical-mechanical polishing is one accepted method of planarization. This planarization method typically requires that the substrate be mounted on a carrier or a polishing head, with the surface of the substrate to be polished exposed. The substrate is then placed against a rotating polishing pad. In addition, the carrier head may rotate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical-mechanical polishing process are: the finish (roughness) and flatness (lack of large-scale topography) of the substrate surface, and the polishing rate. Inadequate flatness and finish can produce substrate defects. Polishing rate sets a time needed to polish a layer. Thus, it sets the maximum throughput of the polishing apparatus.

Each polishing pad provides a surface, which, in combination with the specific slurry mixture, can provide specific polishing characteristics. Thus, for any material being polished, the pad and slurry combination is theoretically capable of providing a specified finish and flatness on the polished surface. The pad and slurry combination can provide this finish and flatness in a specified polishing time. Additional factors, such as the relative speed between the substrate and pad, and the force pressing the substrate against the pad, affect the polishing rate, finish and flatness.

Because inadequate flatness and finish can create defective substrates, the selection of a polishing pad and slurry combination is usually dictated by the required finish and flatness. Given these constraints, the polishing time needed to achieve the required finish and flatness sets the maximum throughput of the polishing apparatus.

An additional limitation on polishing throughput is "glazing" of the polishing pad. Glazing occurs when the polishing pad is heated and compressed in regions where the substrate is pressed against it. The peaks of the polishing pad are pressed down and the pits of the polishing pad are filled up, so the surface of the polishing pad becomes smoother and less abrasive. As a result, the polishing time required to polish a substrate increases. Therefore, the polishing pad surface must be periodically returned to an abrasive condition, or "conditioned" to maintain a high throughput.

An additional consideration in the production of integrated circuits is process and product stability. To achieve a low defect rate, each successive substrate should be polished under similar conditions. Each substrate should be polished by approximately the same amount so that each integrated circuit is substantially identical.

One of the factors that is accounted for in returning the polishing pad to its condition prior to the polishing of the wafer is the removal from the polishing pad of the debris created during the polishing period. These debris may be on the surface of the polishing pad or trapped within grooves of the polishing pad. If the debris are left on and within the pad, the polishing conditions for the next pad to be polished will be different from the previous pad that was just polished.

A typical method of removing the debris from the polishing pad after a wafer has been polished is to employ a spray rinse arm over the surface of the polishing pad. The spray rinse arm provides a rinse of de-ionized water to wash away the debris from the polishing pad once a wafer has been polished. Although the use of a spray rinse arm provides some measure of cleaning to the polishing pad, some debris may remain behind, especially within grooves in the polishing pad. One possible way to increase the cleaning action of the spray rinse arm is to employ a brush that would mechanically loosen the debris from the polishing pad. Such brush heads are not typically used, however, since bristles from conventional brushes are not adequately secured to prevent their dislodgement from the brush onto the polishing pad surface. Hence, even after cleaning of the polishing pad, a brush bristle may be present on a polishing pad. A bristle that remains on a polishing pad may scratch a wafer that is subsequently polished on the pad.

One of the methods to secure bristles together in typical brushes is to staple the bristles together and then force the stapled bristles into brush holes, where the bristles expand within the brush holes. However, this method of attaching the bristles to the brush does not adequately secure the bristles into the brush and they typically fall out of the brush.

A second method to attach bristles to a brush is to hand-tie the bristles into bundles, push the bundles through a brush head and tie the bristle bundles together. However, in order to hand-tie the bristles, a very large number of bristles is needed in each bundle, and the bristle bundles become much too stiff for use in a pad cleaning brush.

A third possible method of securing bristles to a brush is to epoxy the end of the bristles to the brush. However, this is problematic, since the viscosity of the epoxy used to secure the bristles makes it difficult, if not impossible, to force the bristles into the epoxy.

SUMMARY OF THE INVENTION

There is a need for a pad cleaning brush for cleaning the polishing pads of a chemical-mechanical polishing apparatus that securely retains the bristles on a brush head and prevents bristles from falling onto the polishing pad surface.

This and other needs are met by embodiments of the present invention which provide a pad cleaning brush for cleaning a polishing pad of a chemical-mechanical polishing apparatus. The pad cleaning brush comprises a brush head with a cleaning side and an attachment side. A plurality of apertures extend through the brush head and open at the cleaning side and the attachment side. The brush also has a plurality of bristle bundles. Each bristle bundle is located in a respective one of the apertures with a brushing portion extending from the cleaning side of the brush head and an attachment portion extending from and welded to the attachment side of the brush head.

One of the advantages of the present invention is the secure attachment of the bristle bundles to the brush head, provided by the welding of the bristle bundles to the -brush head. By providing such a secure attachment, a brush may be reliably used in the polishing pad cleaning process. Hence, a deep and thorough cleaning of the polishing pad is possible, with a reduction in the possibility of a bristle remaining on the polishing pad surface to possibly scratch a subsequently polished wafer. In certain preferred embodiments, the bristle bundles are further secured by epoxy used to attach the brush head to a spray rinse arm. The epoxy acts to encase the portions of the bristle bundles that have been welded to the brush head.

The earlier stated needs are also met by another embodiment of the present invention which provides a method of forming a pad cleaning brush for cleaning a polishing pad of a chemical-mechanical polish apparatus. In this method, bristle bundles are inserted through apertures of a brush head and the bristle bundles are then welded to the brush head.

The earlier stated needs are also met by another embodiment of the present invention which provides a chemical-mechanical polishing apparatus comprising a platen that holds the polishing pad, and a pad cleaning brush. The pad cleaning brush has a brush head with a cleaning side and an attachment side. It also has a plurality of apertures extending thorough the brush head and opening at the cleaning side and the attachment side, and a plurality of bristle bundles. Each bristle bundle is located in a respective one in the apertures with a brushing portion extending from the cleaning side of the brush head and an attachment portion extending from and welded to the attachment side of the brush head.

Additional advantages of the present invention will become readily apparent to those skilled in this art from the following detailed description, simply by way of illustration of the best mode contemplated for carrying out the present invention. As will be realized, the present invention is capable of other and different embodiments and that several details are capable of modifications in various and obvious respects, all without departing from the present invention. Accordingly, the drawings and descriptions are to be regarded as illustrative in nature, and not as restrictive.

DETAILED DESCRIPTION OF THE INVENTION

The present invention relates to the cleaning of polishing pads after the polishing of a wafer in a chemical-mechanical polishing apparatus. The present invention addresses and solves problems related to thoroughly cleaning debris from the polishing pad of the chemical-mechanical apparatus by employing a brush in conjunction with a rinse spray arm. At the same time, the possibility of bristles from the brush remaining on the polishing pad after the cleaning of the polishing pad is prevented by the welding of the bristles to the brush head of the brush, in accordance with embodiments of the present invention.

Figure 1:
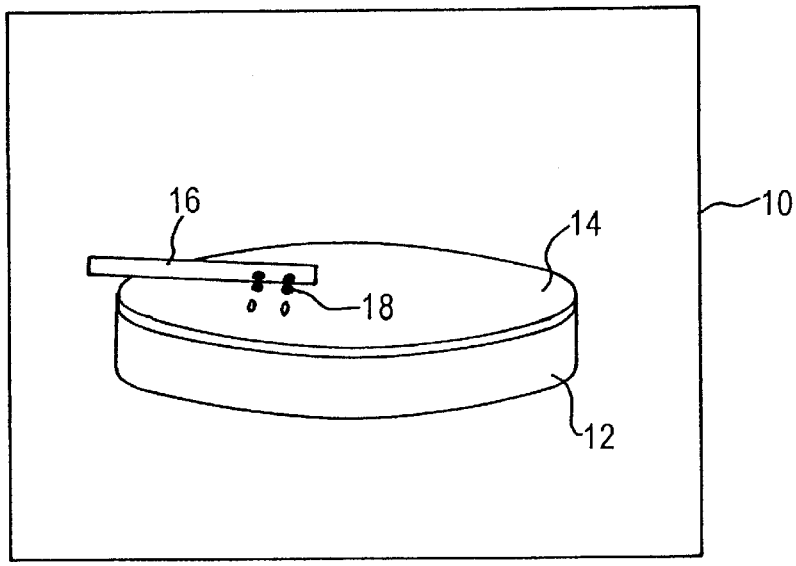
FIG. 1 is a simplified perspective view of a portion of a chemical-mechanical polishing apparatus that has a polishing pad cleaning system in accordance with the prior art.

FIG. 1 is a perspective view of a chemical-mechanical polishing apparatus 10 that employs a polishing pad cleaning apparatus in accordance with the prior art. The apparatus 10 includes a rotatable platen 12 on which a polishing pad 14 is disposed. A wafer (not shown) carried by a carrier head is moved downwardly into contact with the polishing pad 14. The carrier head and the polishing pad 14 are rotated relative to one another and slurry is introduced. After the wafer has been polished and moved to the next station or from the CMP apparatus 10, the polishing pad 14 is cleaned by a spray of de-ionized water. A rinse spray arm 16 is positioned over the surface of the polishing pad 14. The de-ionized water is sprayed from nozzles 18 in the rinse spray arm 16. The de-ionized water carries away the debris from the polishing pad 14. Although the use of a rinse spray arm and de-ionized water is adequate to clean most of the debris from a polishing pad, a more thorough cleaning of polishing pads is desirable especially with the advent of polishing pads containing grooves in which the debris may become trapped.

In order to overcome the above-stated concern of cleaning debris more thoroughly from the polishing pad, the present invention provides a polishing pad cleaning brush that acts in conjunction with a rinsing of the polishing pad to more thoroughly clean the debris from the polishing pad. At the same time, however, the brush of the present invention has its bristles attached in a manner to prevent bristle loss onto the surface of the polishing pad and thereby prevents the bristles from scratching subsequently polished wafers.

Figure 2A:
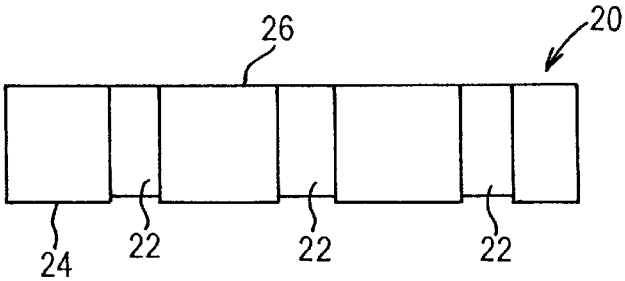
FIG. 2*a* is a schematic cross-sectional view of a brush head constructed in accordance with an embodiment of the present invention.
Figure 2B:
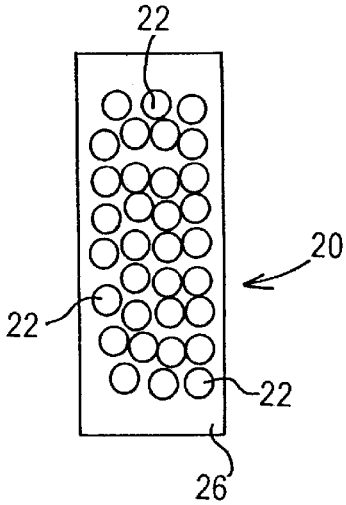
FIG. 2*b* is a top view of the brush head of FIG. 2A.

A cross-sectional side view of a brush head 20 of a pad cleaning brush constructed in accordance with the present invention is provided in FIG. 2*a*. Brush head 20 may be made of any suitable material, such as aluminum, stainless steel, etc. The plurality of apertures 22 extends completely through the brush head 20. The apertures 22 therefore have openings at the cleaning side 24 of the brush head 20, and the attachment side 26. For clarity purposes, only a relatively few numbers of apertures 22 are depicted in FIG. 2*a*. However, in actual practice, a large number of apertures 22 are present in the brush head 20 in order to provide the pad cleaning brush with an adequate number of bristles. A top view of the brush head 20 is depicted in FIG. 2*b*.

Figure 3:
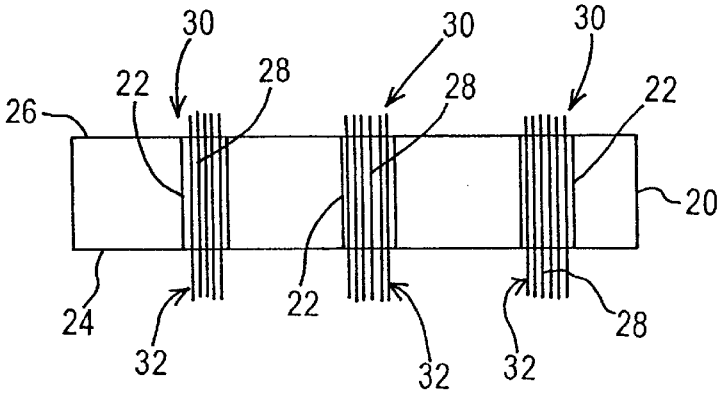
FIG. 3 is a cross-sectional view of the brush head of FIG. 2*a* after bristle bundles have been inserted through the apertures in the brush head.

FIG. 3 shows the brush head 20 after bristle bundles 28 are inserted through the apertures 22 of the brush head 20. The bristle bundles are formed by a plurality of bristles, made of polyurethane or any other suitable material. The bristle bundles 28 are inserted through the aperture 22 so that an attachment portion 30 extends above the attachment side 26 of the brush head 20. A remaining brushing portion 32 of the bristle bundle 28 extends below the cleaning side 24 of the brush head 20. The brushing portion 32 is the portion of the bristle bundle 28 that interacts with the polishing pad to clean the debris from the polishing pad after a polishing operation. The attachment portions 30 of the bristle bundles 28 are held in place by a machine, in preferred embodiments of the method of assembly of the brush head, serve to attach the bristle bundles 28 to the brush head 20.

Figure 4:
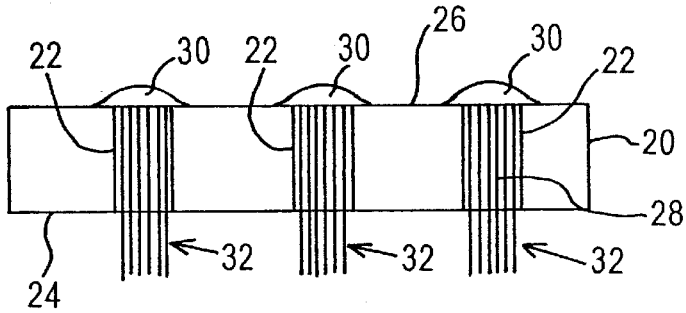
FIG. 4 is a cross-sectional view of the brush of FIG. 3 after a welding operation has been performed to attach the bristle bundles to the brush head, in accordance with embodiments with the present invention.
Figure 5:
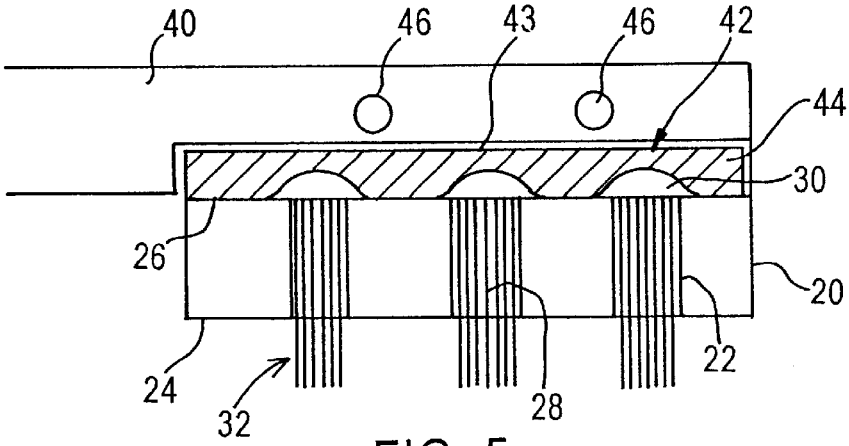
FIG. 5 is a cross-sectional view of the polishing pad brush after a spray rinse arm has been attached to the brush head, in accordance with embodiments of the present invention.

The brush head of FIG. 3 is depicted in FIG. 4 after an attachment procedure has been formed to attach the bristle bundles 28 securely to the brush head 20. In preferred embodiments of the invention, the attachment portion 30 of the bristle bundles 28 are welded to the brush head 20 at the attachment side 26. A heat gun may be used, for example, with a temperature setting sufficient to melt material making up the bristles of the bristle bundle 28. In the exemplary embodiment, the heat gun needs to be able to melt polyurethane. Once the welding has been performed, bristle bundles 28 are securely attached to the brush head 20. It may occur that a few bristles are disconnected or break off due to the heating procedure. These may be removed from the brush by a tape lift off method or simply tapping the brush against a hard surface to shake out any loose bristles prior to installation and use of the brush head 20. Once those few bristles are removed, however, the remaining bristles attached by the welding process of the present invention should remain in place during pad polishing cleaning operations. This prevents the bristles from remaining on the pad after a pad polishing cleaning operation, thereby decreasing the risk of scratching a wafer that is subsequently polished on the polishing pad.

The bristle bundle is further secured to the brush head 20 with a cover 43 that has a recess 42 into which epoxy 44 or other suitable adhesive is provided. The cover 43 of the brush head 20 is then slidably coupled to the spray rinse arm 40. The attachment portions 30 are encased by the epoxy 44 and further secured in place in the brush head 20. The spray rinse arm 40 also contains nozzles 46 from which de-ionized water is sprayed onto the surface of the polishing pad during the cleaning operation.

One of the advantages of the attachment of bristle bundles 28 by the welding process and the use of epoxy or other adhesive, is that a smaller number of bristles may be used in the aperture 22 since the process of stuffing bristles into an aperture and then allowing the expansion of the bristles within the aperture to hold the bristles is not relied upon. In those types of brushes, the large number of bristles packed tightly together increases the stiffness of the brush bristles dramatically. Hence, the present invention can retain the relative softness of the bristles, increasing the desired brushing action of the pad cleaning brush.

Figure 6:
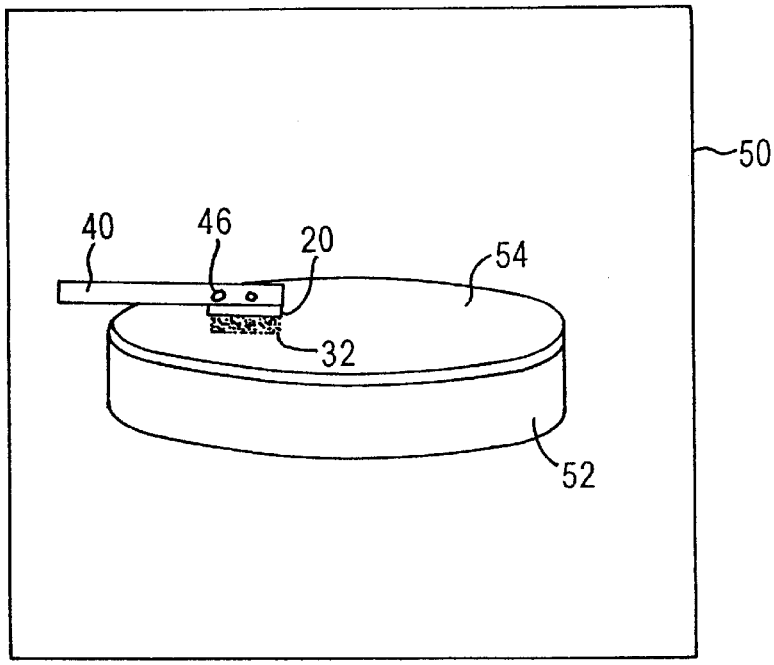
FIG. 6 is a perspective view of a chemical-mechanical polishing apparatus constructed in accordance with embodiments of the present invention.

A perspective view of the pad cleaning brush with the attached spray rinse arm 40 is depicted in perspective view of FIG. 6. The CMP apparatus 50 is not shown in full, with only a single platen 52 of one polishing station being shown. The platen 52 supports a polishing pad 54. The spray rinse arm 40 and attached brush head 20 are depicted as being in place for a cleaning operation with the polishing pad 54. The spray rinse arm 40 and brush head 20 are dimensioned to extend over the radius of the polishing pad 54. In the cleaning operation, the spray water is directed on both sides of the spray rinse arm 40. Hence, the water is sprayed onto the polishing pad 54 in front of the bristles 28, so that the bristles 28 will interact with the water and clean the debris out of the polishing pad 54. The water is also sprayed behind the bristle bundles 28 to remove the debris from polishing pad 54 that have been mechanically loosened by the brushing portion 32 of the bristle bundles 28.

The present invention as described above provides a more thorough cleaning of the polishing pad by employing a brush in conjunction with the spray rinse water than is provided by spray rinse water alone. This is accomplished with a reduced risk of bristles remaining on the polishing pad after the polishing pad cleaning operation is completed.

Although the present invention has been described and illustrated in detail, it is to be clearly understood that the same is by way of illustration and example only, and is not to be taken by way of limitation, the scope of present invention being limited only by the terms of the appended claims.

What is claimed is:

1. A pad cleaning brush for cleaning a polishing pad of a chemical-mechanical polishing apparatus, comprising:

a brush head with a cleaning side and an attachment side, and a plurality of apertures extending through the brush head and opening at the cleaning side and the attachment side;

a plurality of bristle bundles, each bristle bundle located in a respective one of the apertures with a brushing portion extending from the cleaning side of the brush head and an attachment portion extending from and affixed to the attachment side of the brush head; and a cover that covers the attachment portion of the bristle bundles.

2. The brush of claim 1, further comprising a spray rinse arm fixed to the attachment side of the brush head.

3. The brush of claim 2, wherein the cover has a recess that covers the attachment portion of the bristle bundles.

4. The brush of claim 3, further comprising an adhesive in the recess that encases the attachment portion of the bristle bundles.

5. The brush of claim 4, wherein the adhesive comprises epoxy.

6. The brush of claim 5, wherein each bristle bundle comprises a plurality of polyurethane bristles.

7. The brush of claim 5, wherein the brush head is stainless steel.

* * * * *